United States Patent [19]

Chung

[11] Patent Number: 5,046,633

[45] Date of Patent: Sep. 10, 1991

[54] STRUCTURE OF RICE BOWL

[76] Inventor: Chin-Fu Chung, No. 18, Hsin Hsing Rd., Tainan, Taiwan

[21] Appl. No.: 467,105

[22] Filed: Jan. 18, 1990

[51] Int. Cl.[5] ..... B65D 6/24; B65D 21/00; B65D 25/16; H05B 6/80

[52] U.S. Cl. ..... 220/407; 99/426; 99/DIG. 14; 219/10.55 E; 220/405; 220/410; 220/912

[58] Field of Search ..... 99/403, 426, 449, DIG. 14; 219/10.55 E; 220/405, 407, 410, 408, 400, 403, 912, DIG. 14; 215/13.1; 426/107, 243; 126/390

[56] References Cited

U.S. PATENT DOCUMENTS

| | | | |
|---|---|---|---|
| 797,314 | 8/1905 | Owens | 220/912 |
| 3,199,757 | 8/1965 | McConnell | 220/DIG. 14 |
| 3,760,972 | 9/1973 | McKirnan | 220/410 |
| 3,765,559 | 10/1973 | Sauey et al. | 220/410 |
| 3,934,748 | 1/1976 | Racz | 220/410 |
| 4,348,421 | 9/1982 | Sakakibara | 220/408 |
| 4,704,510 | 11/1987 | Matsui | 99/DIG. 14 |
| 4,713,510 | 12/1987 | Quick et al. | 219/10.55 E |
| 4,756,446 | 7/1988 | Gen et al. | 220/408 |
| 4,801,017 | 1/1989 | Artusi | 220/405 |
| 4,823,979 | 4/1989 | Clark, Jr. | 220/407 |

FOREIGN PATENT DOCUMENTS

| | | | |
|---|---|---|---|
| 2639324 | 5/1990 | France | 220/407 |
| 2057250 | 4/1981 | United Kingdom | 220/405 |

*Primary Examiner*—Timothy F. Simone
*Attorney, Agent, or Firm*—Varndell Legal Group

[57] ABSTRACT

A rice bowl, which comprises a plurality layers of plastic films smoothly secured thereto by means of a retainer ring and covering over the deep, rounded body thereof. The plastic films can be split off one after another each time after meal, so that the rice bowl can be repeatedly used without the need to wash.

1 Claim, 6 Drawing Sheets

STRUCTURE OF RICE BOWL

BACKGROUND OF THE INVENTION

The present invention relates to rice bowls and more particularly to a rice bowl which can be repeatedly used without the need to wash.

Conventional disposable kitchen utensils are generally made of foamed plastics, which are to be thrown away each time after use. However, the use of foamed plastics may cause an environmental pollution because regular foamed plastics are not dissolvable in the weather.

Further, foamed plastics may produce chemical reaction when it is used to contain hot fluid. During chemical reaction, harmful substances may produce simultaneously. Therefore, it is harmful to people's health to use such kind of disposable products for containing foods.

An object of the present invention is to provide a rice bowl which can be repeatedly used without the need to wash.

Another object of the present invention is to provide a rice bowl in which the cover layers are made of a kind of plastic material which does not cause chemical reaction when it is heated by hot fluid.

Still another object of the present invention is to provide a rice bowl which does not produce environmental pollution.

A yet further object of the present invention is to provide a rice bowl which is inexpensive to manufacture.

In an embodiment of the present invention, a rice bowl includes a deep, rounded body which comprises several layers of plastic films smoothly secured thereto by means of a retainer ring. Two inner circular channels which have each a wider inner bottom and a narrower upper open are internally made on the body of the rice bowl so that the plastic films can be firmly retained thereto when they are covering over the surface of the rice bowl. The plastic films can be easily split off one after another through an indented line each time after meal, so that the rice bowl can be repeatedly used without the need to wash.

DETAILED DESCRIPTION OF THE PREFERRED EMBODIMENTS

Figure 2:
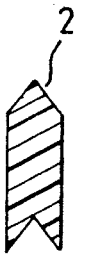
FIG. 2 is a cross-sectional view of a retainer ring according to the present invention.
Figure 1:
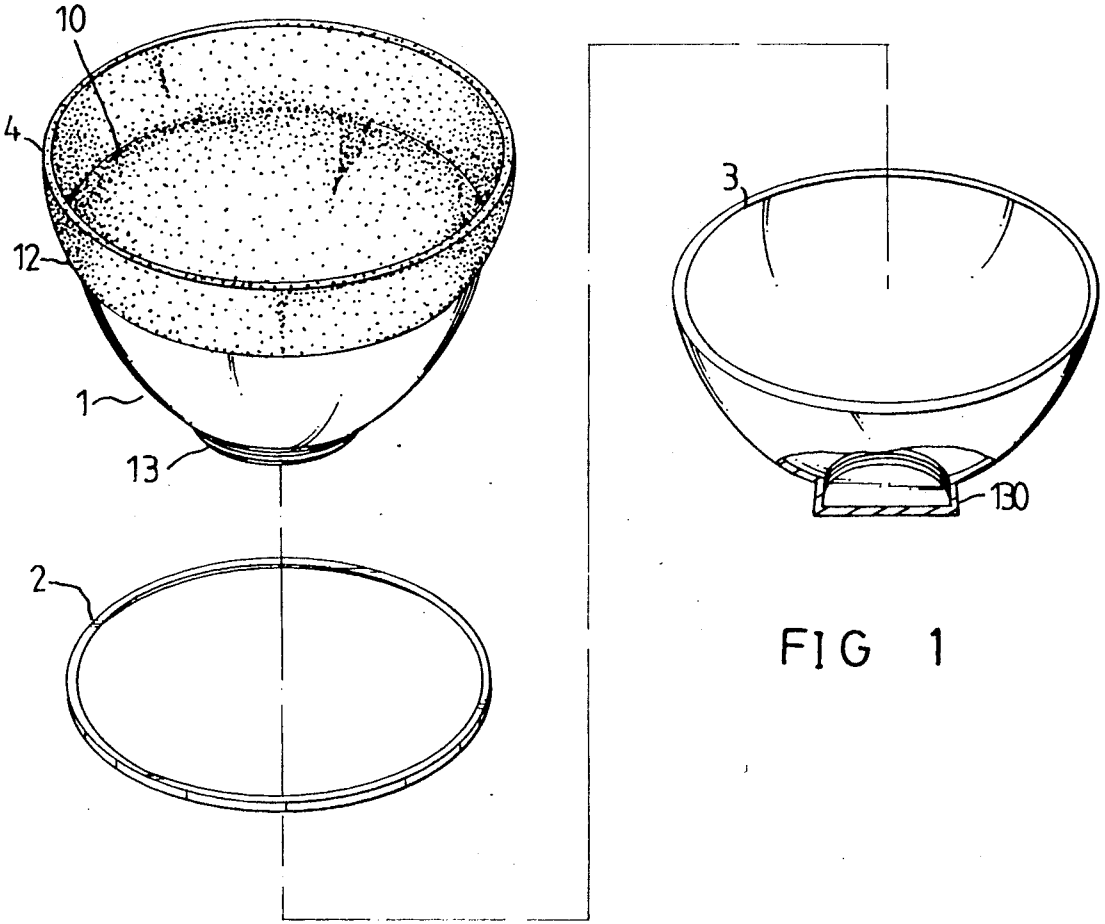
FIG. 1 is a fragmentary perspective view of a rice bowl in accordance with the present invention.
Figure 4:
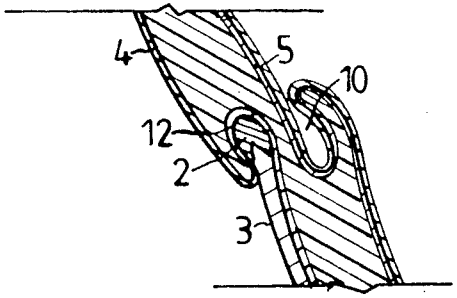
FIG. 4 is a partly sectional view of a rice bowl according to the present invention, illustrating the positioning of plastic films and sponge sheet in an inner circular channel and a retainer ring in an external circular channel.
Figure 3:
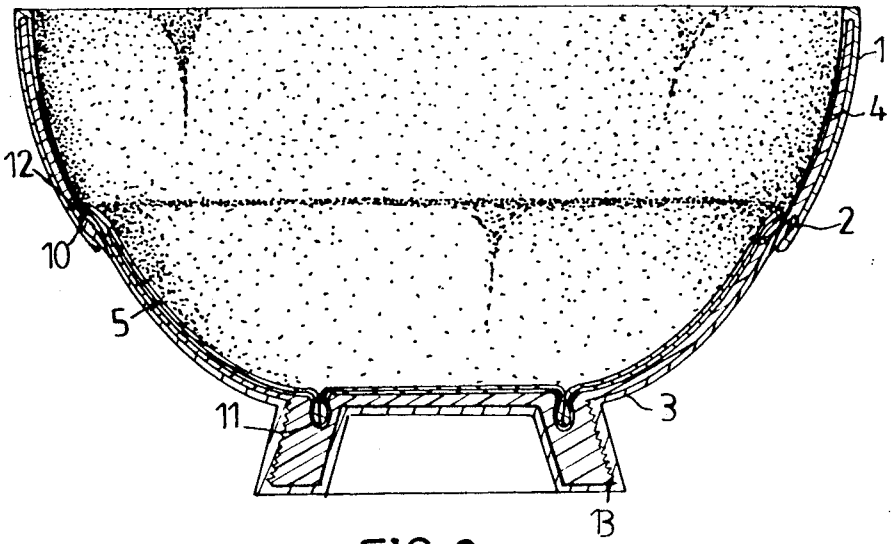
FIG. 3 is a sectional assembly view of a rice bowl according to the present invention.

Referring to FIGS. 1 through 4, a rice bowl in accordance with the present invention is generally comprised of a body 1, a retainer ring 2, a body holder 3, a set of plastic films 4 and a sponge sheet 5, wherein the plastic films 4 and the sponge sheet 5 are pressed to firmly attach to and cover on the inner surface of the deep, rounded body 1. As illustrated, the body 1 comprises two inner circular channels 10, 11, internally around its inner bottom and inner flank portion. The two circular channels 10, 11 have each a cross section including a wider inner bottom and a relatively narrower upper opening so that the plastic films 4 (or Mylar films) can be firmly retained thereto. An external circular channel 12 is made on the body 1 around its outer flank portion so that the retainer ring 2 (which has an arrow-like cross section as illustrated in FIG. 2) can be mounted thereon to bind up the plastic films 4 thereto. An outer thread 13 is made on the base portion of the bowl 1 so that the bowl holder 3 can be secured thereto through screw joint. As alternate forms of the present invention, the bowl holder 3 can be attached to the base of the bowl through any known connecting methods.

Figure 6:
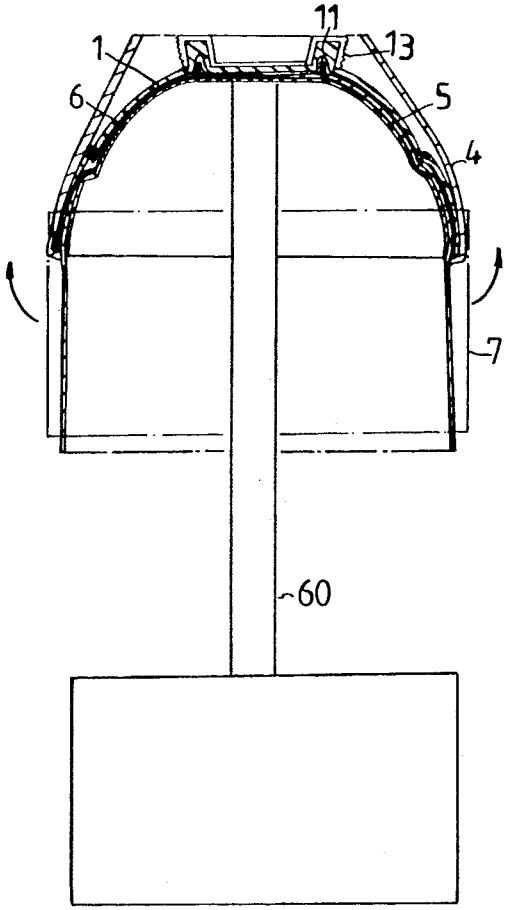
FIGS. 5 through 10 illustrate a rice bowl production flow chart according to the present invention.
Figure 5:
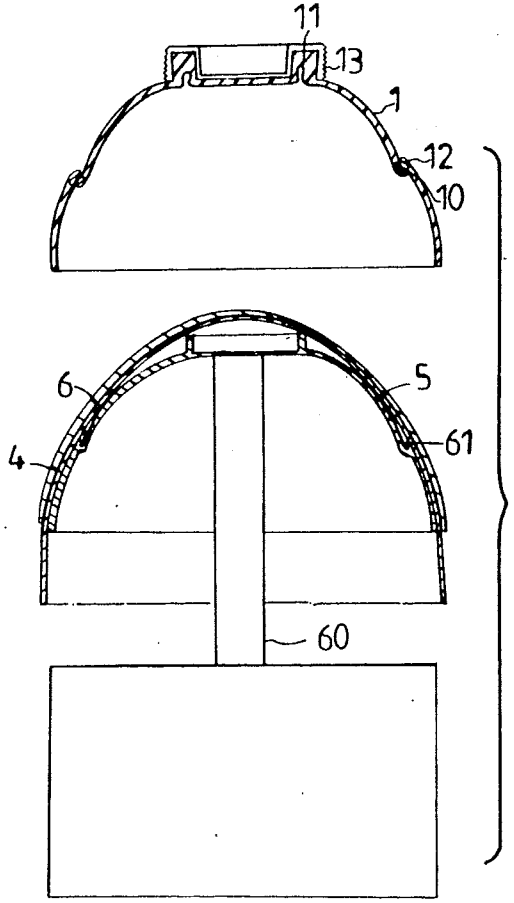
Figure 8:
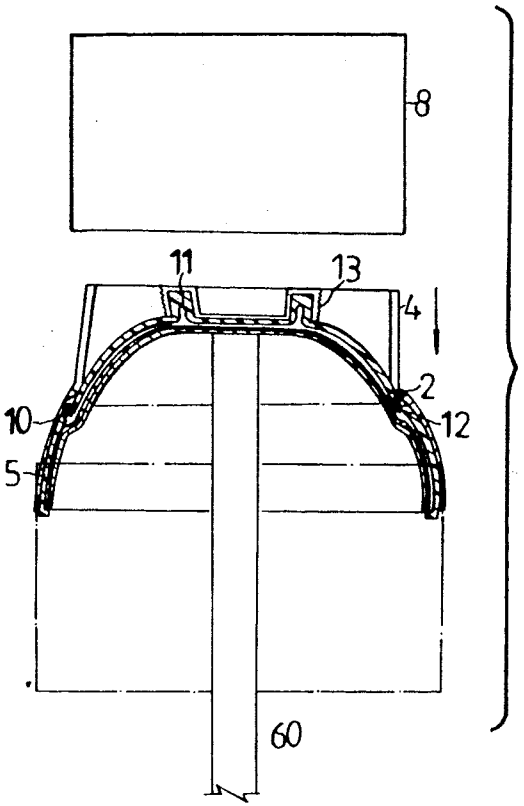
Figure 7:
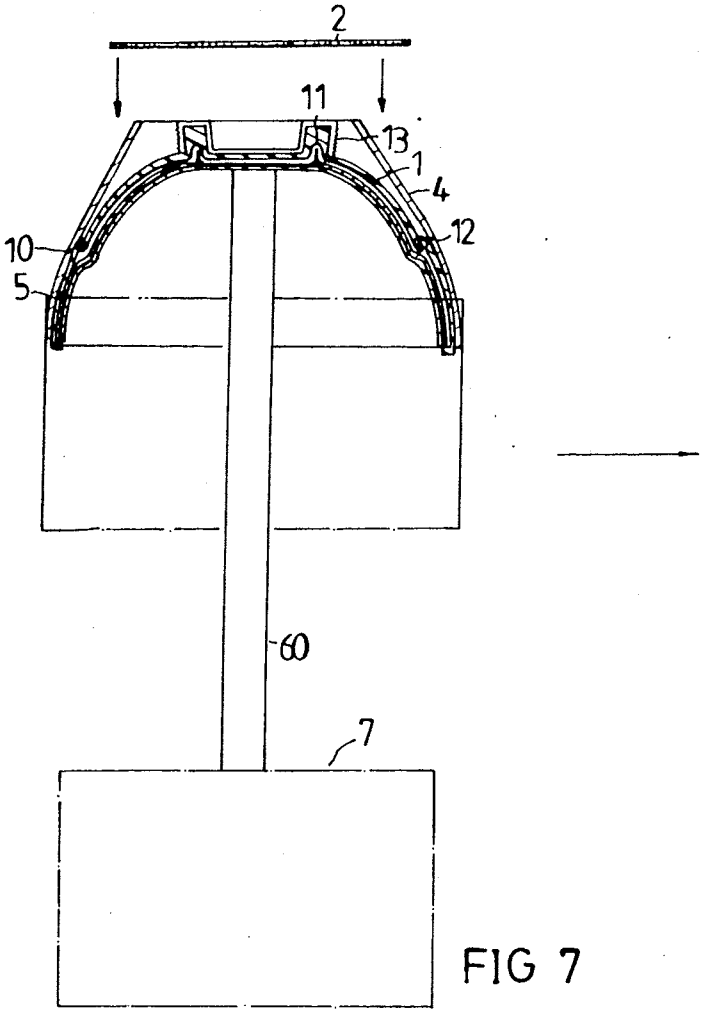

FIGS. 5 through 10 illustrate a rice bowl production process according to the present invention. Referring first to FIGS. 5 and 6, a body 1 is positioned upside-down (with its open disposed downward) and disposed right above a bowl-shaped wooden mold 6. A set of plastic films (or Mylar films) 4 is mounted on the bowl-shaped wooden mold 6 which is fixedly secured to a movable stand 60, a sponge sheet 5 is further mounted on the bowl-shaped wooden mold 6 above the plastic films 4. The movable stand 60 is then moved upward to push its top bowl-like wooden mold 6 against the body 1 permitting the circular projecting portions 61, which are externally made on the wooden mold 6 corresponding to the two circular channels 10, 11 of the body 1, to respectively insert in the two circular channels 10, 11 of the body 1 such that the sponge sheet 5 and the plastic films 4 are simultaneously squeezed to secure to the body 1 and become firmly retained by the two circular channels 10, 11 of the body 1. Because the circular channels 10, 11 have each a wider inner bottom and narrower upper opening, the sponge sheet 5 and the plastic films 4 can be firmly clamped by the circular channels 10, 11 as soon as they are pushed to insert therein. As soon as the plastic films 4 and the sponge sheet 5 are pressed to secure to the body 1, a movable sleeve 7 is pushed to sleeve on the body 1 so as to turn the protruding portion of the plastic films 4 to cover over the outer wall surface of the body 1. Now, please refer to FIGS. 7 and 8. After the protruding portion of the plastic films 4 are forced by the movable sleeve 7 to cover on the outer wall surface of the body 1, a retainer ring 2 is directly mounted the outer wall of the body 1 over the plastic films 4. A rotary cylinder 8 which comprises cutting elements is moved downward to push the retainer ring 2 to seat in the external circular channel 12 of the body 1 so as to bind up the plastic films 4 with the body 1. During the operation of the rotary cylinder 8, the useless protruding portions of the plastic films 4 are trimmed by the cutting elements of the rotary cylinder 8 and the plastic films 4 are simultaneously pressed smooth on the body 1.

Figure 10:
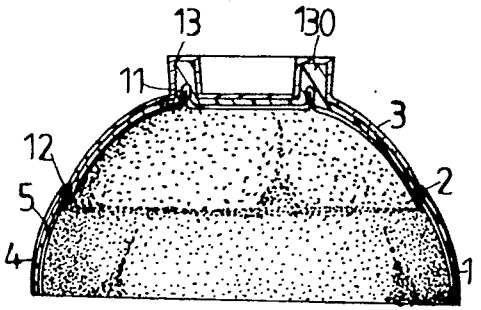
Figure 9:
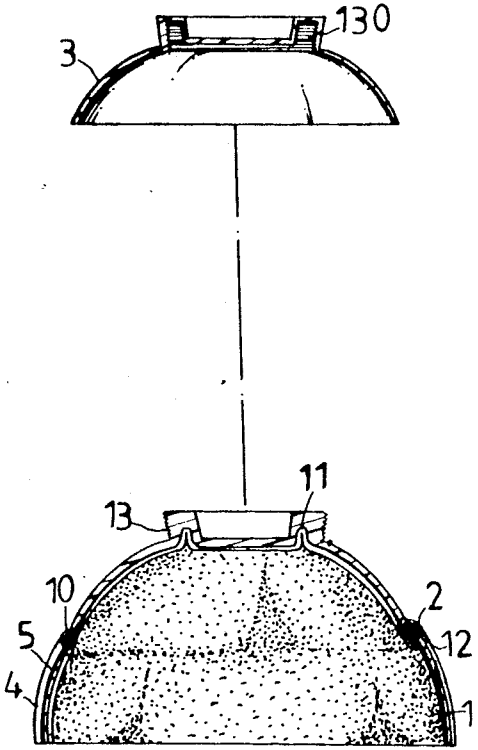

Referring to FIGS. 9 and 10, after plastic films or Mylar films are covered on a body 1, bowl holder 3 which has an inner thread 130 is secured to the outer thread 13 of the base of the body 1 permitting the edge of the bowl holder 3 firmly pressed on the retainer ring 2 which is mounted on the external circular channel 12 of the body 1. FIG. 10 illustrates a finished product according to the present invention.

Figure 12:
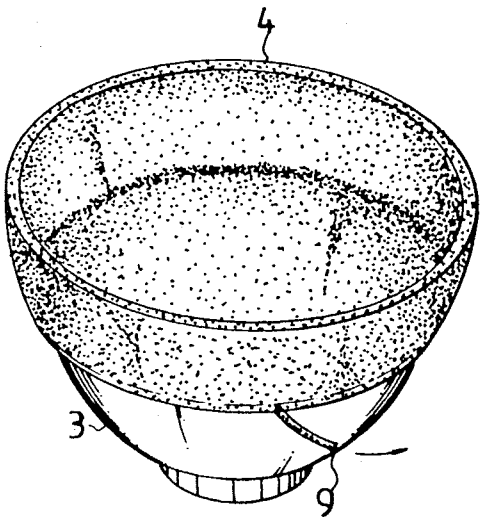
FIG. 12 illustrates an operation to split off an outer layer of plastic films from a rice bowl in accordance with the present invention.
Figure 11:
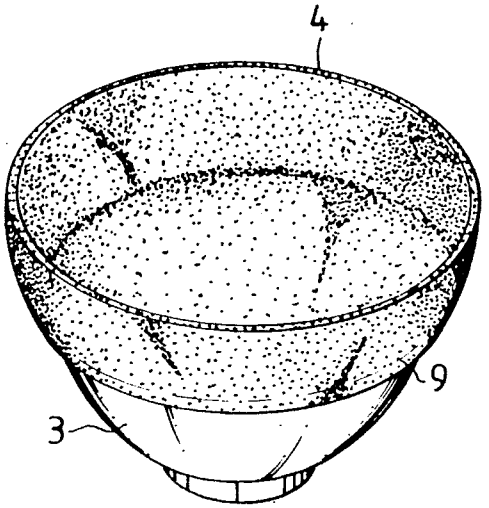
FIG. 11 is a perspective view of a rice bowl embodying the present invention.

Referring to FIGS. 11 and 12, the outer layer of plastic films 4 on the body 1 of a bowl in accordance with the present invention can be split off each time after meal, through the indented line 9 which is made on the plastic films during the production of the same, such that a clean bowl is ready for immediate use without the need to wash it.

I claim:

1. A rice bowl, including a deep, rounded body comprising a base having thereon an outer thread, two inner circular channels internally around its inner bottom and inner flank portion, said two inner circular channels having each a cross-section including a wider inner bottom and a relatively narrower upper opening, and an external circular channel around its outer flank portion;

a retainer ring having an arrow-like cross-section and being externally mounted on said body to seat in said external circular channel;

a set of plastic films covering over the inner surface of said body and firmly clamped by said inner channels with its edge inserted in said external circular channel and firmly retained therein by said retainer ring;

a body holder in shape suitable for holding said body, having an inner thread portion to screw up with the outer thread of the base of said body;

characterized in that the set of plastic films can be split off one after another each time after meal, so that the rice bowl can be repeatedly used without the need to wash.

* * * * *